United States Patent [19]

Gotoh et al.

[11] 4,261,719

[45] Apr. 14, 1981

[54] METHOD OF AND APPARATUS FOR CONTROLLING RATE OF MATERIAL AIR SUPPLY TO AIR SEPARATION PLANT

[75] Inventors: Akiyoshi Gotoh; Taichi Katsuki, both of Kobe; Takaharu Goto, Higashimachi; Takumi Mizokawa; Noritoshi Sakai, both of Kobe, all of Japan

[73] Assignee: Kobe Steel, Ltd., Kobe, Japan

[21] Appl. No.: 6,535

[22] Filed: Jan. 25, 1979

Related U.S. Application Data

[63] Continuation of Ser. No. 787,518, Apr. 14, 1977, abandoned.

[30] Foreign Application Priority Data

Apr. 14, 1976 [JP] Japan ..... 51/42879

[51] Int. Cl.[3] ..... F25J 3/04

[52] U.S. Cl. ..... 62/21; 62/29

[58] Field of Search ..... 62/53–55, 62/29, 30, 25, 37

[56] References Cited

U.S. PATENT DOCUMENTS 3,912,476 10/1975 Mikawa et al. ..... 62/37

*Primary Examiner*—Norman Yudkoff

*Attorney, Agent, or Firm*—Oblon, Fisher, Spivak, McClelland & Maier

[57] ABSTRACT

A method of and apparatus for optimizing the rate of material air supply to an air separation plant, for preserving a stable operation of the plant, through stabilizing heat balance and material balance in the plant irrespective of variation in the flow rate of a gas through an expansion turbine incorporated in the plant and the flow rate of product gases so as to optimize the purity and amount of produced gas. The control for the optimization is performed making a ratio of the difference between the flow rate of the material air and the flow rate of the gas through the expansion turbine to the flow rate of the product gases, as an essential factor for the control.

14 Claims, 8 Drawing Figures

-·-·- VARIATION OF PURITY OF PRODUCT GAS ACCORDING TO VARIATION OF MATERIAL AIR FLOW RATE

—— VARIATION OF PURITY OF PRODUCT GAS ACCORDING TO VARIATION OF FLOW RATE OF GAS THROUGH EXPANSION TURBINE

- - - - VARIATION OF PURITY OF PRODUCT GAS ACCORDING TO SIMULTANEOUS VARIATION OF BOTH FLOW RATE OF GAS THROUGH EXPANSION TURBINE AND MATERIAL AIR FLOW RATE

METHOD OF AND APPARATUS FOR CONTROLLING RATE OF MATERIAL AIR SUPPLY TO AIR SEPARATION PLANT

This is a continuation, of application Ser. No. 787,518, now abandoned, filed Apr. 14, 1977.

BACKGROUND OF THE INVENTION

1. Field of the Invention

The present invention relates generally to an air separation plant and more specifically to a method of and apparatus for optimizing the rate of material air supply to an air separation plant.

2. Description of the Prior Art

The main products from an air separation plant are oxygen and nitrogen. One of the essential factors for preserving the amounts and purities of these products stable is to maintain a sufficient rate of material air supply to the air separation plant. Since the demand or consumption of the oxygen and nitrogen product varies widely, because they are intermediate products having a variety of ways of use, the required amount of material air supply to the air separation plant varies correspondingly. For this reason, an air compressor for supplying the material air must be controlled frequently.

Conventionally, this control of the air compressor has been performed manually, in accordance with the required amount of material air which is determined by the ratio of the flow rate of the material air to that of the product gases. This conventional manual control of the air compressor has been found, however, to be inconvenient in that it causes an unstable material balance in the air separation plant, resulting in a large fluctuation of the purities of the product gases.

SUMMARY OF THE INVENTION

It is therefore an object of the present invention to stabilize and optimize the heat balance and the material balance in the air separation plant, to thereby stabilize the operation of the plant by providing an improved controlling method and an apparatus for performing the same.

It is another object of the invention to provide a controlling method and apparatus for ensuring constant purities of the product gases irrespective of fluctuations of the flow rates of a gas through an expansion turbine and the product gases.

It is still another object of the invention to provide a method and apparatus for performing the control of the first and the second objects easily and efficiently.

To these ends, according to one aspect of the invention, a practical embodiment of the invention include means for controlling the flow rate of the material air, means for measuring the flow rate of the material air, means for measuring a flow rate of a gas to an expansion turbine, means for measuring the flow rate of the product gas, operation means for remembering a predetermined relationship between the flow rate of the product gas and a ratio of difference between the flow rate of the material air and the flow rate of the gas to the expansion turbine to the flow rate of the product gas and to operate or calculate the required flow rate of material air, and controlling means for controlling the material air flow rate in correspondence with the value of the material air flow rate calculated by the operation means. Thus, in this embodiment, the material air supply to the air separation plant is controlled in accordance with the operated or calculated required material air flow rate obtained on the basis of the aforementioned predetermined relationship, from output signals delivered by the means for measuring the gas flow rate to the expansion turbine and the means for measuring the flow rate of the product gas.

In a second embodiment of the invention, there is provided, in addition to the arrangement for the first embodiment, means for comparing the flow rate of the material air provided by the measuring means with that calculated or operated by the operation means. The material air flow rate controlling means are operated in accordance with the result of the comparison.

According to still another aspect of the invention, there is provided a third embodiment in which there is a provision of means for interrupting the signal from the means for measuring the material air flow rate, in addition to the arrangement of the second embodiment. When there is caused a variation of the material air supply by switching the gas pressure of a switchable heat-exchanger, a comparison is made between the material air flow rate before the switching and the calculated flow rate for the control of the material air flow rate.

According to still another aspect, a fourth embodiment is provided having means for measuring the purity of the product gas. The result of the measurement is used for correcting the calculated material air flow rate.

BRIEF DESCRIPTION OF THE DRAWINGS

Other objects and advantages of the present invention will become apparent from the following description when taken in conjunction with the accompanying drawings, wherein.

DESCRIPTION OF THE PREFERRED EMBODIMENTS

Figure 1:
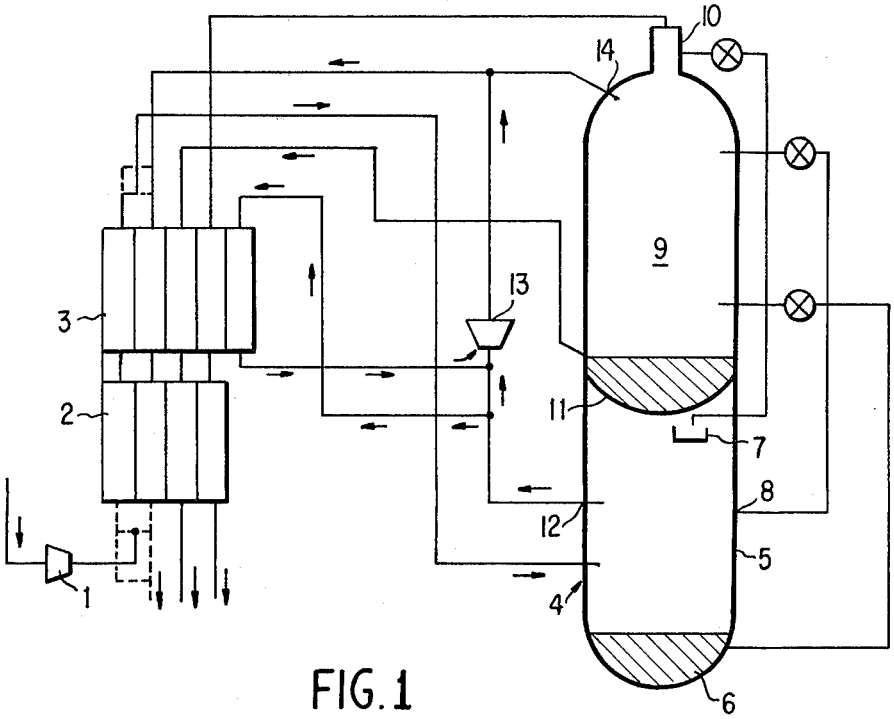
FIG. 1 is a flow chart of an air separation plant.

Prior to the description of the invention, an explanation will be made hereinunder as to a general arrangement for a tonnage oxygen plant with specific reference to FIG. 1.

The material air supplied by an air compressor 1 is made to pass through a plurality of switchable heat exchangers (only one of them is shown) 2,3 to be cooled to −168° to −170° C., before entering a lower column 5 of a rectification column 4.

The air is pre-rectified in the lower column 5 so that liquified $O_2$ of a purity of 38 to 40% is generated at the bottom of the lower column 5.

Meanwhile, nitrogen gas is generated at the upper portion of the lower column 5, which is then led to a main condenser (not shown) to be cooled thereby to become liquified nitrogen. The liquified nitrogen is introduced again into the lower column 5 and is stored in a distribution tank 7.

The liquified air (38 to 40% $O_2$) at the bottom 6 of the lower column 5, nitrogen gas of a purity of about 98% extracted from an intermediate portion 8 of the lower column 5, and the liquified nitrogen available at the distribution tank 7 are introduced into an upper column 9 of the rectification column 4 for further rectification.

Consequently, nitrogen gas of 99.999% purity and liquified oxygen of about 99.6% purity are generated at the top portion 10 and the bottom portion 11 of the upper column 9.

Approximately 99.999% purity nitrogen gas at the top 10 of the upper column 9 is then introduced into the switchable heat exchangers 2,3, while the about 99.6% purity oxygen gas at the bottom 11 of the upper column 9 is also introduced to the switchable heat exchangers.

These low temperature gases effectively cool the material air in the heat exchangers and become the product nitrogen and oxygen, respectively.

The material air includes or contains impurities such as $CO_2$, $H_2O$,CO and so on, which are turned to dry ice or ice, when cooled in the heat exchangers 2,3, to stick to the tube wall to thereby clog the heat exchangers 2,3.

In order to prevent the clogging of the heat exchangers, the dry ice or ice sticking to the tube wall is periodically blown off and carried away by a flow of waste nitrogen, through a periodical switching of the heat exchanger from the material air flow passage to the waste nitrogen flow passage. The blown off dry ice or ice is finally discharged into atmosphere along with the waste nitrogen. The waste nitrogen at the top portion 14 of the upper column 9 is mixed with 2% $O_2$ gas extracted from an intermediate portion 12 of the lower column 5 which has been cooled down to about −175° C. through an adiabatic expansion through an expansion turbine 13 subsequent to a cooling through the heat exchanger 3 after the extraction.

For an effective removal of the dry ice or ice from the tube wall, the temperature difference between the material air and the coolant, i.e. the product nitrogen or oxygen is preferably within 4° C. For this purpose, a part or all of the extracted gas from the rectification column 4 is passed through the heat exchanger 3 to control the temperature difference. The air separation plant is operated in the above described manner.

Since the operation relies entirely upon difference of boiling points between nitrogen and oxygen for separating the nitrogen and oxygen, without chemical reactions, it is strictly required to maintain good heat balance and material balance for achieving a stable operation of the plant.

Concerning the heat balance at first, it is to be pointed out that a certain loss of heat is inevitably caused during the heat exchange, because the heat transfer between the material air and the outflowing oxygen, nitrogen and the waste nitrogen across the heat exchanger is not performed at 100% efficiency.

At the same time, since the heat insulation of the plant from the ambient air cannot be perfect, a loss of heat results by an escape of the heat to the ambient air.

In addition, loss of heat is inevitably caused in a liquid air absorber (this functions to remove impurities in the liquified air), liquid oxygen absorber (this is for removing impurities such as $C_2H_2$ from the liquified oxygen) when these absorbers are switched for the purpose of gelation for reuse.

Loss of heat is also inevitable during the extraction of liquified oxygen and nitrogen from the rectification column.

Referring now to the material balance, the material air introduced into the plant is finally changed into the oxygen, nitrogen and waste nitrogen which are discharged respectively.

When there are some extractions of the liquified oxygen and nitrogen from the rectification column, the extraction amount takes a certain percentage to the material air supply amount constituting one of the factors for the material balance. In order to maintain the heat balance through compensating for the heat loss, the flow rate of a gas to the expansion turbine 13 is controlled to obtain various degrees of cold column 4.

Since this amount of gas flowing through the expansion turbine does not make any contribution to the rectification in the rectification column, the material balance will be disturbed to mar the stable output of the product gases, when the flow rate of a gas through the expansion turbine is not taken into consideration.

Thus, for maintaining a good material balance in the plant, the material air flow rate has to be changed frequently.

In this connection, it is to be noted that the material air flow rate, i.e. the flow rate of the inlet material air is controlled in accordance with the ratio of the difference between the material air flow rate and the flow rate of a gas through the expansion turbine to the flow rate of the product gas, in consideration with the change in the flow rate of the gas through the expansion turbine and the product gas.

Figure 3:
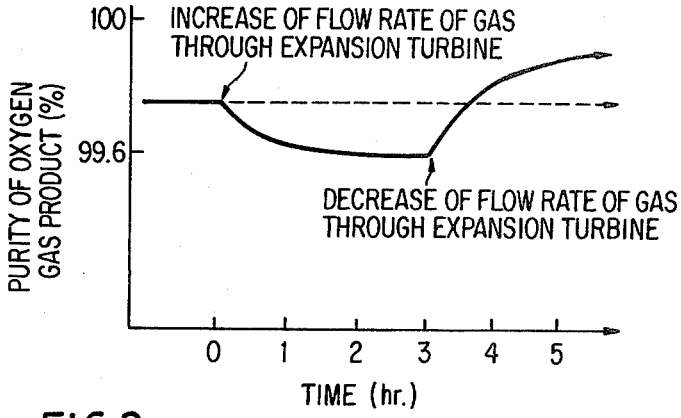
FIG. 3 is a graphical representation of the change in the purity of the product oxygen gas in accordance with the fluctuation of the flow rate of a gas through an expansion turbine.
Figure 4:
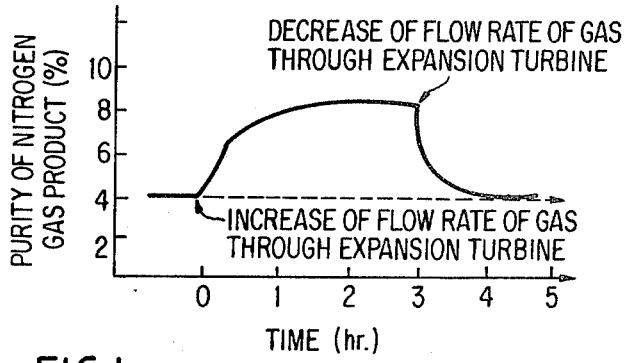
FIG. 4 is a graphical representation of the change in the purity of product nitrogen gas in accordance with the fluctuation of the flow rate of a gas through the expansion turbine.

To explain in more detail, assuming here that there are no changes in the flow rates of the material air and the product gas, and there is no extraction of liquified oxygen and nitrogen from the rectification column, the material balance is disturbed to cause fluctuations in the purities of the product gases as shown in full-line curves of FIGS. 3 and 4, in accordance with the change in the flow rate of a gas through the expansion turbine.

However, according to the control making use of the controlling factor of the invention, the purities of the product gases are maintained constant as will be seen from the broken line curves.

Figure 2:
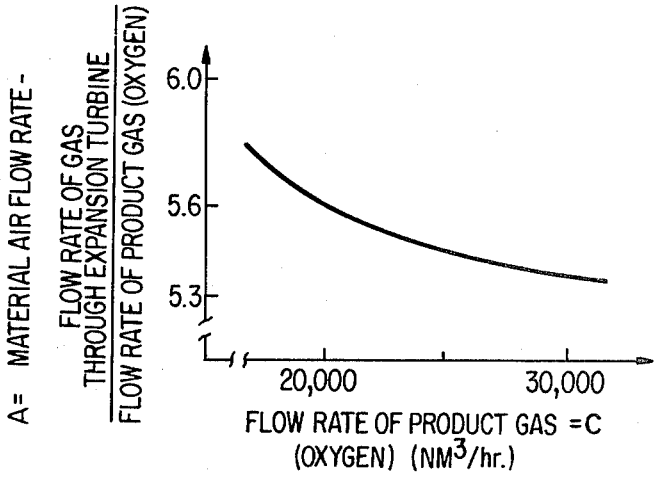
FIG. 2 is a graph showing an embodiment of a relationship used for calculating material air flow rate in accordance with the invention.

For this control, the relationship is preferably obtained previously, through experiments or analysis of the actual running of the plant, which concerns flow rate of the product oxygen, ratio of the difference between the material air flow rate and the flow rate of the gas through the expansion turbine 13 to the flow rate of the product oxygen, as shown, for example, in FIG. 2, assuming there is no extraction of the liquified nitrogen and oxygen.

Then, the required or optimum flow rate of the material air can be read from the graph, using parameters of the flow rate of the gas through the expansion turbine with respect to the flow rate of the product oxygen.

The actual material air flow rate is controlled then in accordance with the above determined optimum value. To this end, for example, the opening degree of a flow control valve disposed in the passage of the material air is regulated in accordance with the result of a comparison of the actual flow rate measured by a flow meter with the above determined optimum material air flow rate.

When this control is adopted, the flow rate of the material air is caused to change for each occurrence of the periodical switching of the heat exchangers. In order to avoid this, the signal from the flow meter for the material air may be interrupted for a while until the fluctuation or change of the material air flow rate is naughted, i.e. until the flow rate is settled again, so that the comparison may be made between the actual flow rate of the material air just before the switching and the determined optimum flow rate, during the switching of the heat exchanger. In this case, the interruption of the signal from the flow meter is performed upon a signal for closing a pressure equalizing value which is incorporated in the switchable heat exchanger. When the liquefied products are extracted from the rectification column, the afore-mentioned relationship should be, preferably, determined in consideration with the amount of the liquefied products.

Preferably, the determined optimum flow rate of the material air is corrected in accordance with the actual purities of the product gases. Referring now to a practical embodiment shown in FIG. 5, an air compressor 1 is connected to a switchable heat exchanger 2 incorporated in an air separation plant 26, through a pipe 15.

A pressure regulating valve 16 and a flow meter 17 are disposed in the pipe 15.

Interrupting means 19 are adapted to receive a signal from switching means 18 for switching the heat exchanger 2. The flow meter 17 is connected to a flow rate controller 24 through the interrupting means 19.

An operation unit for calculating the optimum material air flow rate 23 is connected to a flow meter 21 for measuring the flow rate of gas through an expansion turbine incorporated in the plant 26, and to a flow meter 22 for measuring the flow rate of the product oxygen.

The operation unit 23 is connected to the flow rate controller 24 which in turn is connected to a flow rate control valve 25.

In operation, the material air is compressed by the air compressor 1 and is delivered to the switchable heat exchanger 2 through the pipe 15.

The flow rate of the material air through the pipe 15 is detected and measured by the flow meter 17, and is transmitted to the flow rate controller 24 through the interrupting means 19.

When the switchable heat exchanger is switched, a pressure equalizing valve incorporated in the switching means 18 is closed. A signal for closing this valve is transmitted to the interrupting means 19 which acts to interrupt the signal transmission from the flow meter 17 to the controller 24, until the change or fluctuation of the material air flow rate due to the switching of the passage in the heat exchanger 2 is naughted, i.e. the flow rate is settled again. The flow rate controller 24, however, remembers the actual or measured flow rate of the material just before the switching of the heat exchanger.

The flow rate of the gas through the expansion turbine is varied in accordance with the extraction amount of the liquified oxygen and nitrogen from the rectification column and with the change in the heat balance attributable to heat losses in the equipment of the air separation plant 26. Thus, the flow rate of a gas through the expansion turbine is transmitted from the flow meter 21 to the operation unit 23. The operation unit also receives the signal representative of the flow rate of the product oxygen from the flow meter 22.

The operation unit 23 in which the relationship, as shown in FIG. 2, is remembered calculates the optimum value of the material air flow rate, from the signals delivered by the flow meters 21,22, and outputs or transmits the calculated value to the flow rate controller 24.

Figure 5:
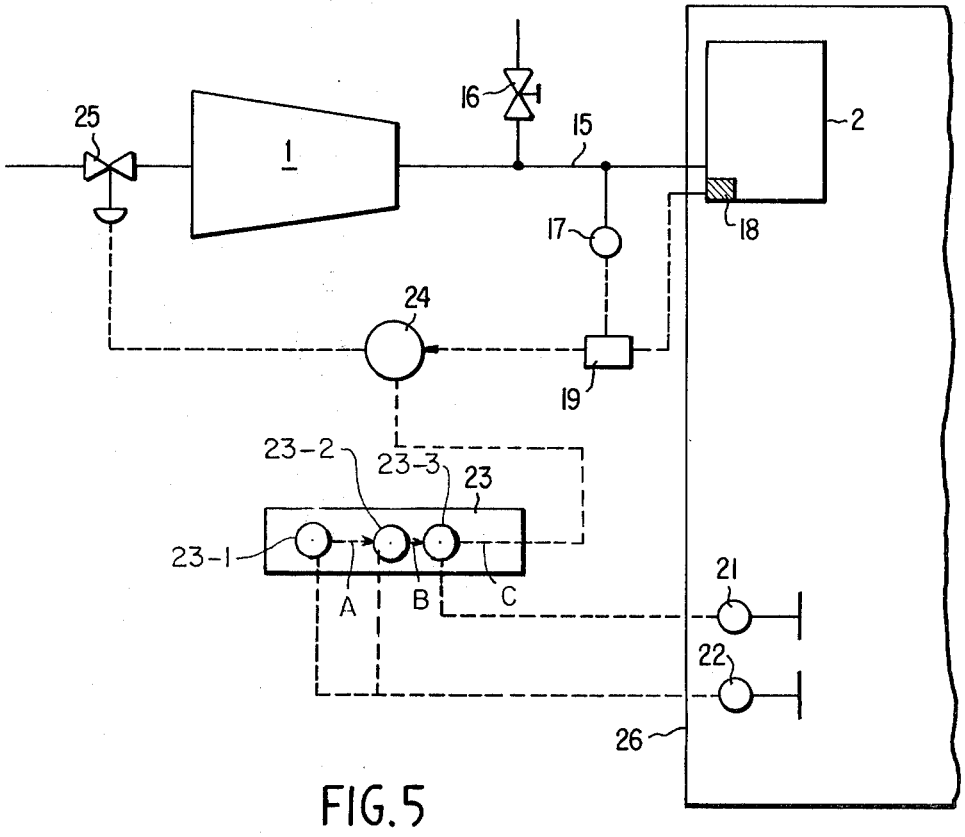
FIG. 5 is a flow chart of a controlling method for controlling the material air flow rate in accordance with the invention.

The best way to understand the control system of the present invention is to explain in greater detail, the operation unit 23 in FIG. 5. FIG. 5 is an illustration of one of operation unit 23 in FIG. 5 wherein, $$A = \frac{\text{material air flow rate} - \text{flow rate of gas through the expansion turbine}}{\text{flow rate of product gas } O_2}$$

$B$ = material air flow rate − flow rate of gas through the expansion turbine $C$ = material air flow rate (set value)

Initially, the product gas $O_2$ flow rate is input to graph setting device 23-1 wherein the graph shows:

$$\frac{\text{product gas } O_2 \text{ flow rate vs. material air flow rate} - \text{flow rate of gas through the expansion turbine}}{\text{flow rate of product gas } O_2}$$

as further illustrated in FIG. 2. From this graph, $$\text{output}\left(\text{i.e.}\ \frac{\text{material air flow rate} - \text{flow rate of gas through the expansion turbine}}{\text{flow rate of product gas } O_2}\right)$$

is determined by using the flow rate of product gas $O_2$ as an input. The output A of graph setting device 23-1 is applied to multiplying calculator 23-2 from which the following calculation is made:

$$\frac{\text{material air flow rate} - \text{flow rate of gas through the expansion turbine}}{\text{flow rate of product gas } O_2} \times (\text{flow rate of product gas } O_2).$$

From the above calculation, the value B (material air flow rate−flow rate of gas through the expansion turbine) is obtained as the output from calculator 23-2.

An additive calculator 23-3 is further utilized to which output from calculator 23-2, i.e. (material air flow rate−flow rate of gas through the expansion turbine) and expansion turbine flow rate from 21 are input as follows:

(material air flow rate−flow rate of gas through the expansion turbine)+(expansion turbine flow rate).

Then, material air flow rate is obtained. The value obtained from additive calculator 23-3 is the output of operation unit 23 and output from operation unit 23 as the setting value of 24. Taking into consideration the above, FIG. 3 and FIG. 4 are explained as follows. Output B from calculator 23-2 is constant if the flow rate of produce gas $O_2$ is constant. If flow rate of gas through the expansion turbine increases, then output C of additive calculator 23-3 is increased in value.

This increased output C is applied to flow controller 24 in which material air flow rate is controlled to increase the same value. Generally, in the air separation plant, purity of product gas is improved only when the material air flow rate is increased and the other conditions are fixed. Accordingly, the increased value of the material air flow rate compensates for the reduction of purity of product gas due to the increase of flow rate of gas through the expansion turbine and, therefore, the purity is kept almost constant. On the contrary, when the flow rate of gas through the expansion turbine decreases, output C of additive calculator 23-3 decreases at the same value because output B is constant. As a result, the flow rate of material air also decreases the same value. If the other conditions are kept constant, the decrease of material air flow rate results in undesirable purity. However, such is balanced by desirable purity due to the decrease of the flow rate of gas through the expansion turbine and consequently, the purity thereof is kept constant.

Figure 6:
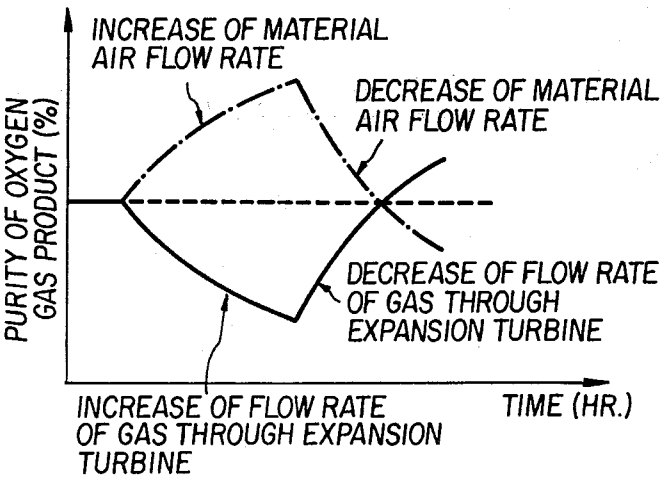
FIGS. 6 and 7 is a graphical representation of the operation of the present invention.
Figure 7:
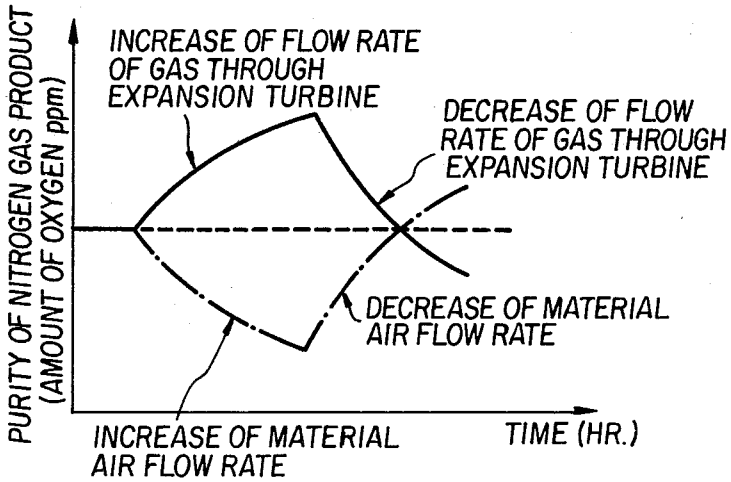

To further explain, in case that the other process variables and conditions are constant, purity of product gas becomes higher when material air flow rate is increased. The above process variables mean, for example, flow rate of gas through the expansion turbine. In other words, in case that flow rate of gas through the expansion turbine is constant, purity of product gas becomes higher when material air flow rate is increased. Then, as is understood from FIGS. 3-4, in case the material air flow rate is kept constant and flow rate of gas through the expansion turbine is increased, purity of product gas becomes lower. Therefore, from the above explanation, it will be understood that purity of product gas becomes constant when both flow rate of gas through the expansion turbine and material air flow rate are increased, because both effects are counterbalanced, as shown in FIGS. 6 and 7. On the other hand, according to the present invention, material air flow rate is increased when flow rate of gas through the expansion turbine is increased so that purity of product gas is kept constant as is understood from the foregoing explanation and FIGS. 6 and 7 and equally, flow rate of gas through the expansion turbine is decreased when material air flow rate is decreased so that purity of product gas is kept constant.

A different way of expressing the foregoing is by the equation (See FIG. 5)

$$F\,A\text{set} = \underbrace{\underbrace{\underbrace{X(Fo)}_{A}\,Fo}_{B} + Ft}_{C}$$

wherein,

F Aset : material air flow rate (pre-determined)

Fo : product gas flow rate

Ft : flow rate of gas through the expansion turbine

Figure 8:
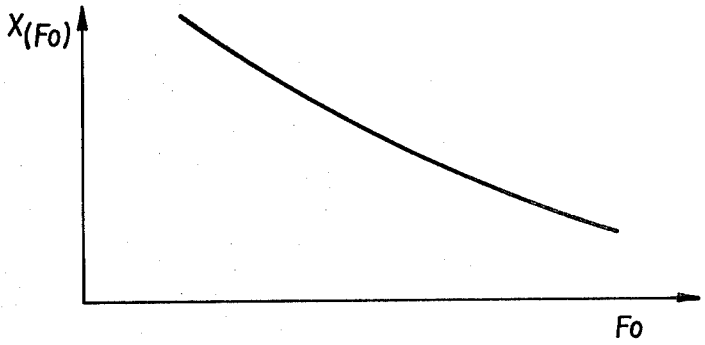
FIG. 8 is a graphical representation of the memorizing functions of the calculator of the present invention.

X(Fo) : Fo vs.

$$\frac{\text{(material air flow rate} - \text{flow rate of gas through the expansion turbine)}}{\text{product gas flow rate}}$$

which calculator 23-1 memorizes in such a manner as shown in FIG. 8.

In the above equation, since X (Fo) becomes constant if Fo is constant, when Ft is increased, F Aset is also increased at an equal amount and when Ft is decreased, F Aset is also decreased at an equal amount.

The flow rate controller 24 then acts to compare the actual flow rate transmitted from the interrupting means 19 with the calculated optimum value of the material air flow rate, and controls the flow rate control valve 25 to optimize the flow rate of the material air to the air compressor 1.

In summary, the present invention controls the flow rate of the material air to the air separation plant in accordance with the rate of the difference between the material air flow rate and the flow rate of a gas through the expansion turbine to the flow rate of the product oxygen, and provides advantageous effects over the prior art as summarized below.

(1) The rectification is stabilized by avoiding a disturbance attrilutable to the change in the flow rate of a gas through the expansion turbine, to stabilize the amount and purities of the product gases, ensuring a continuous operation of the plant.

(2) The amount of the product gases can be varied without loosing the established optimum material balance, without difficulty.

(3) An automatical flow rate control for the material air is provided.

(4) The disturbance due to the switching of the switchable heat exchanger can be avoided.

Obviously, numerous modifications and variations of the present invention are possible in light of the above teachings. It is therefore to be understood that within the scope of the appended claims, the invention may be practiced otherwise than as specifically described herein.

What is claimed is:

1. A method of controlling the flow rate of material air supply to an air separation plant having switchable heat exchangers and an expansion turbine so as to optimize the purity and amount of product gas, comprising the steps of: controlling the flow rate of the material air supply to said air separation plant making use of a range of ratios from about 4.0 to 7.0 of the difference between the material air flow rate and a flow rate of a gas through said expansion turbine to the flow rate of the product gas, as a factor for the control.

2. A method of controlling the flow rate of material air supply to an air separation plant having a switchable heat exchanger and an expansion turbine, so as to optimize the purity and amount of product gas, comprising the steps of: determining an optimum flow rate of the material air from a flow rate of gas through said expansion turbine and flow rate of a product gas, on the basis of a predetermined relationship between the flow rate of the product gas and a ratio of difference between the material air flow rate and said flow rate of the gas through said expansion turbine to said flow rate of the product gas, said ratio being in the range of from about 4.0 to 7.0, and controlling the flow rate of the material air in accordance with the determined value of the optimum flow rate.

3. A method as claimed in claim 2, wherein the control of the flow rate of the material air is made in accordance with a result of a comparison of the measured flow rate of said material air with said determined value of optimum material air flow rate.

4. A method as claimed in claim 3, wherein said comparison is made between said measured flow rate of said material air just before switching of said switching heat exchanger and the determined value of optimum flow rate of material air for controlling the material air supply to said air separation plant, during the fluctuation of the material air supply due to a switching of the gas passages of said switchable heat exchanger.

5. A method as claimed in claim 2, wherein said flow rate of said material air supplied to said air separation plant is automatically controlled.

6. A method as claimed in claim 2, wherein said product gas is oxygen.

7. A method as claimed in claim 2, wherein said product gas is nitrogen.

8. An apparatus for controlling the flow rate of material air to an air separation plant having a switchable heat exchanger and an expansion turbine and for optimizing the purity and amount of product gas which comprises:

means provided in the passage for said material air to said switchable heat exchanger for adjusting the flow rate of said material air through said passage;

first means provided in said passage for said material air to said switchable heat exchanger for measuring the flow rate of said material air through said passage and obtaining a first signal therefrom;

second means provided in a passage of a gas to said expansion turbine for measuring the flow rate of said gas to said expansion turbine and obtaining a second signal therefrom;

third means provided in a passage of a product gas for measuring the flow rate of said product gas and obtaining a third signal therefrom;

operation means connected to receive said second and third signals and having means for remembering a predetermined relationship between the flow rate of said product gas and a ratio of a difference between said flow rate of said material air and said flow rate of gas to said expansion turbine to said flow rate of said product gas, said ratio being in the range of about 4.0 to 7.0, and for determining an optimum flow rate of material air corresponding to the signals from said second and third means on the basis of said predetermined relationship and obtaining a fourth signal therefrom;

means for comparing the first and fourth signals to obtain a control signal and for controlling said adjusting means in accordance with said optimum flow rate of material air determined by said operation means.

9. An apparatus as claimed in claim 8 which further comprises means for interrupting the signal from said first means for measuring the flow rate of said material air, during a fluctuation of said flow rate of said material air due to a switching of gas passages of said switchable heat exchanger.

10. An apparatus as claimed in claim 8, which further comprises means provided in said passage for product gas for measuring the purity of said product gas, and means for cooperating with said purity measuring means in correcting said optimum flow rate determined by said operation means.

11. A method for controlling the rate of material air supply to an air separation plant having a rectification column, a switchable heat exchanger and an expansion turbine, comprising the steps of:

measuring the material air flow rate and obtaining a first signal;

measuring the flow rate of gas to the expansion turbine and obtaining a second signal;

measuring the flow rate of product gas and obtaining a third signal;

comparing the third signal with a pre-plotted range of optimum values represented by the ratio of the difference between the material air flow rate and the flow rate of gas through the expansion turbine to the product gas flow rate, said ratio being plotted against the flow rate of product gas, and obtaining therefrom an optimum value for the ratio corresponding to the measured flow rate of product gas, said range of ratios being from about 4.0 to 7.0, and using the ratio thus determined to obtain a fourth signal representative of an optimum material air flow rate;

comparing the signal representative of the optimum material air flow rate to the first signal representative of the actual, measured material air flow rate to obtain a control signal; and using the control signal to control the material air flow rate to the air separation plant.

12. A method as claimed in claim 1, wherein the range of ratios is from about 5.3 to about 6.0.

13. A method as claimed in claim 11, wherein the range of ratios is from about 4.4 to about 6.5.

14. A method as claimed in claim 2, wherein the range of ratios is from about 4.4 to about 6.5.

* * * * *